US006502278B2

(12) United States Patent
Oh et al.

(10) Patent No.: US 6,502,278 B2
(45) Date of Patent: Jan. 7, 2003

(54) UPRIGHT TYPE VACUUM CLEANER HAVING A CYCLONE TYPE DUST COLLECTOR

(76) Inventors: Jang-Keun Oh, 201-708, Haetae Apartment, 385-1, Naebang-dong, Seo-gu, Kwangju-city (KR); Kyu-Chang Park, 201-509, Ochi Jukong Apartment, Ochi-dong, Buk-gu, Kwangju-city (KR)

( * ) Notice: Subject to any disclaimer, the term of this patent is extended or adjusted under 35 U.S.C. 154(b) by 62 days.

(21) Appl. No.: 09/813,603

(22) Filed: Mar. 20, 2001

(65) Prior Publication Data

US 2001/0054213 A1 Dec. 27, 2001

(30) Foreign Application Priority Data

Jun. 24, 2000 (KR) ..... 00-35167
Jun. 24, 2000 (KR) ..... 00-35168

(51) Int. Cl.[7] ..... A47L 9/16

(52) U.S. Cl. ..... 15/353; 15/352; 55/429; 55/459.1

(58) Field of Search ..... 15/352, 353; 55/429, 55/459.1

(56) References Cited

U.S. PATENT DOCUMENTS 4,853,008 A * 8/1989 Dyson ..... 15/353
5,078,761 A * 1/1992 Dyson ..... 55/337
5,090,976 A * 2/1992 Dyson ..... 55/337
5,145,499 A * 9/1992 Dyson ..... 15/352
6,312,594 B1 * 11/2001 Conrad et al. ..... 210/512.1

FOREIGN PATENT DOCUMENTS

| | | | |
|---|---|---|---|
| EP | 0 636 338 | 2/1995 | ..... A47L/9/16 |
| EP | 0 728 435 | 8/1996 | ..... A47L/9/16 |
| EP | 0 923 992 | 6/1999 | ..... B04C/5/04 |
| GB | 2 296 879 | 7/1996 | ..... B04C/3/06 |

OTHER PUBLICATIONS

Search Report issued May 4, 2001 from the British Patent Office with respect to corresponding British Patent Application No. GB 0104824.8.

* cited by examiner

*Primary Examiner*—Chris K. Moore

(57) ABSTRACT

An upright type vacuum cleaner includes a cyclone type dust collector to collect contaminants from the air that is drawn in through a suction brush. The cyclone type dust collector includes a cover, first and second cyclone receptacles, and a lower door. The first cyclone receptacle separates by centrifugal force and collects large particle contaminants. The second cyclone receptacle, disposed in the first cyclone receptacle, separates and collects minute dust and includes a grill having a plurality of fine holes, through which air from the first cyclone receptacle flows into the second cyclone receptacle. The lower door provides access to the contaminants collected in the first and second cyclone receptacles. A reverse flow prevention section is also provided to prevent a reverse flow of contaminants from the lower door.

21 Claims, 7 Drawing Sheets

UPRIGHT TYPE VACUUM CLEANER HAVING A CYCLONE TYPE DUST COLLECTOR

BACKGROUND OF THE INVENTION

1. Field of the Invention

The present invention relates to an upright type vacuum cleaner, and more particularly, to an upright type vacuum cleaner having a cyclone type dust collector capable of separating by centrifugal force and collecting minute particle dust and large particle contaminants from the air that is drawn in through a suction brush of the vacuum cleaner.

2. Description of the Related Art

Generally, an upright type vacuum cleaner includes a suction brush disposed at an end of a vacuum cleaner body for movement across a cleaning surface. An inner space of the vacuum cleaner body is divided into a dust chamber and a motor chamber. A dust filter is removably disposed in the dust chamber. A motor is disposed in the motor driving chamber.

When the motor operates, a strong suction force is generated at the suction brush. The suction force draws contaminants through the suction brush and into the vacuum cleaner body. Once inside the vacuum cleaner body, the air passes through the dust filter, which is disposed in the dust chamber, and is discharged out of the vacuum cleaner. During this process, contaminants in the air are filtered out at the dust filter.

In the upright type vacuum cleaner described above, contaminants, such as dust or dirt, are collected with the use of a dust filter. Accordingly, a user has to provide additional filters for replacement. In addition, the dust filter must be replaced manually, which can be unhygienic for the user.

SUMMARY OF THE INVENTION

The present invention has been made to overcome the above-mentioned problems of the related art. Accordingly, it is an object of the present invention to provide an upright type vacuum cleaner having a cyclone type dust collector for separating by centrifugal force and collecting minute particle dust and larger particle contaminants from the air that is drawn in through a suction brush of the vacuum cleaner.

The above object is accomplished by an upright type vacuum cleaner according to the present invention, including: a body having a dust chamber and a motor driving chamber; a suction brush connected to the body; and a cyclone type dust collector removably disposed in the dust chamber. The cyclone type dust collector, which separates and collects dust and contaminants from the air that is drawn in through the suction brush, includes a cover, first and second cyclone receptacles, and a lower door. The cover has a first air inlet connected to a suction hose, which in turn is connected to the suction brush and the dust chamber, and an air outlet, which is connected to an exhaust hose. The exhaust hose is connected to the dust chamber and the motor driving chamber. The first cyclone receptacle is connected to the cover and induces the air from the first air inlet into a vortex, using the centrifugal force of the vortex to separate and collect larger particle contaminants from the air. The second cyclone receptacle is disposed in the first cyclone receptacle in a manner such that the second cyclone receptacle is also connected to the cover. The second cyclone receptacle includes a grill having a plurality of fine holes, through which air rising from the bottom of the first cyclone receptacle flows, and a second air inlet to guide the air from the fine holes of the grill into a vortex. The lower door is removably mounted on a lower open end of the first cyclone receptacle to permit access to the contaminants collected in the first and second cyclone receptacles, thereby facilitating disposal of the contaminants. The cyclone type dust collector further includes a reverse flow preventing section for preventing a reverse flow of the contaminants from the lower door.

The reverse flow preventing section includes an annular main rib protruding from an inner circumference of the first cyclone receptacle.

The reverse flow preventing section further includes a reverse flow prevention pipe, which protrudes from a lower center of the second cyclone receptacle, having an annular main rib protruding from an inner circumference of the first cyclone receptacle, and a sub-rib protruding from an outer circumference of the reverse flow prevention pipe for preventing a reverse flow of the contaminants.

Further, it is preferable that the main rib is downwardly inclined toward the lower door.

The sub-rib integrally extends from an upper end of the reverse flow prevention pipe radially and is downwardly inclined toward the lower door.

The grill includes a plurality of fine holes formed along the outer circumference of the second cyclone receptacle, with each fine hole being spaced apart by a predetermined distance from adjacent fine holes.

The cyclone type dust collector further includes a hinge shaft for hinging a side of the lower door to a lower side of the first cyclone receptacle, and a locking and unlocking section for locking and unlocking the other side of the lower door to and from the first cyclone receptacle.

The locking and unlocking section includes a locking groove formed in the lower door, a locking rod movably disposed in the first cyclone receptacle to engage the locking groove, a first press member for biasing the locking rod toward the locking groove, and an unlocking unit for disengaging the locking rod from the locking groove, by overcoming an elastic force of the first pressing member.

The unlocking unit also includes an unlocking button disposed on a side of the first cyclone receptacle, a second pressing member for biasing the unlocking button outwardly; a wire, one end of which is connected to the locking rod, and a pivot member. One end of the pivot member is connected to the wire, and the other end is connected to the unlocking button to disengage the locking rod from the locking groove.

The locking and unlocking section is formed in a handle which is disposed on an outer circumference of the first cyclone receptacle.

The above object is also accomplished by an upright type vacuum cleaner according to the present invention, including: a body having a dust chamber and a motor driving chamber; a suction brush connected to the vacuum cleaner body and interconnected to the dust chamber through a connecting tube; a cyclone type dust collector detachably disposed in the dust chamber for separating by centrifugal force and collecting dust and contaminants from the air that is drawn in through the suction brush. The cyclone type dust collector includes: a first cyclone receptacle, substantially cylindrical in shape having two open ends; a second cyclone receptacle coaxially disposed within the first cyclone receptacle with a predetermined space therebetween; a cover for covering upper ends of the first and second cyclone receptacles; a base for covering the lower ends of the first and second cyclone receptacles; and an air exhaust pipe for interconnecting the second cyclone receptacle with the motor driving chamber.

Here, the cyclone type dust collector further includes an annular reverse flow prevention rib protruding from an inner circumference of the first cyclone receptacle toward a center axis at a predetermined sloping angle. It is preferable that the reverse flow prevention rib is downwardly inclined, i.e. toward the base.

The cover includes a tube provided along the inner circumference of the dust chamber. The tube is interconnected with a connecting channel connected to the dust chamber. An inflow pipe radially extends a predetermined length along a ceiling and an inner circumference of the cover. The inflow pipe is interconnected with the tube. The cover further includes suction pipe extending a predetermined depth from a center of the ceiling of the cover. The suction pipe is interconnected with the exhaust pipe.

The suction pipe has a funnel-like shape, in which a free end of the suction pipe radially extends from the suction pipe, gradually increasing a diameter of the suction pipe.

The second cyclone receptacle is substantially cylindrical in shape and has a plane upper side, a tapered side gradually decreasing in a diameter of the cylinder, and a bottom side for covering one end of the cyclone receptacle. The plane upper side has a dual structure formed of an outer body having a plurality of fine holes uniformly formed therein, and an inner body disposed within the outer body at a predetermined distance from the outer body. The bottom side has a guide tube protruding from the center to a predetermined height of the second cyclone receptacle.

The cyclone type dust collector further includes an air outlet formed in an upper end of the inner body of the second cyclone receptacle. The air outlet has an opening that partially overlaps with an opening of the inflow pipe of the cover.

The cyclone type dust collector further includes a guide tube radially extending in a diagonal direction for inducing the air from the air outlet into a vortex.

It is also preferable that the exhaust pipe includes a first exhaust sub-pipe, a second exhaust sub-pipe, and a third exhaust sub pipe. The first, second and exhaust third sub-pipes are respectively formed on the outer surfaces of the cover, the first cyclone receptacle, and the base, while being interconnected with each other.

The second exhaust sub-pipe may be spaced apart from the first cyclone receptacle so as to serve as a handle for the cyclone type dust collector.

The base is removably connected to the first cyclone receptacle.

BRIEF DESCRIPTION OF THE DRAWINGS

The above objects and other features and advantages of the present invention will become readily apparent by reference to the following detailed description when considered in conjunction with the accompanying drawings, in which.

DETAILED DESCRIPTION OF THE PREFERRED EMBODIMENT

The preferred embodiments of the present invention will be described below with reference to the accompanying drawings.

Figure 1:
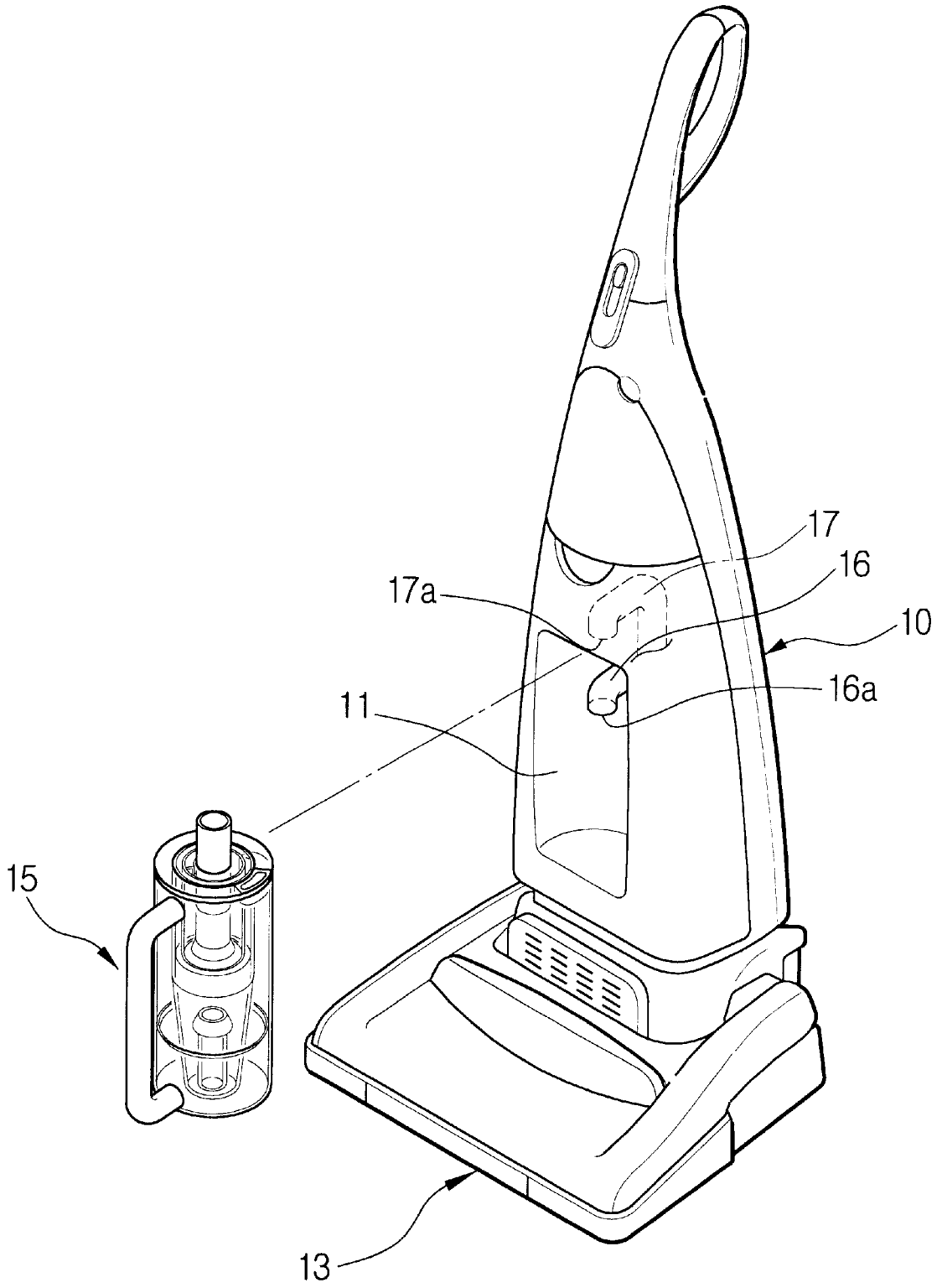
FIG. 1 is a perspective view of an upright type vacuum cleaner having a cyclone type dust collector, in accordance to a preferred embodiment of the present invention, separated therefrom.

Referring to FIG. 1, an upright type vacuum cleaner according to a preferred embodiment of the present invention includes a body 10 having a dust chamber 11 and a motor driving chamber (not shown), a suction brush 13 pivotally connected to the vacuum cleaner body 10. The vacuum cleaner further includes a cyclone type dust collector 15 that is removably disposed in the dust chamber 11.

According to the present invention, the dust chamber 11 includes an air inlet 16*a* and an air outlet 17*a* formed in the inner wall thereof. The air inlet 16*a* is connected to a suction hose 16, which is connected to the suction brush 13. The air outlet 17*a* is connected to an exhaust hose 17 which is connected to the motor driving chamber (not shown).

Figure 2:
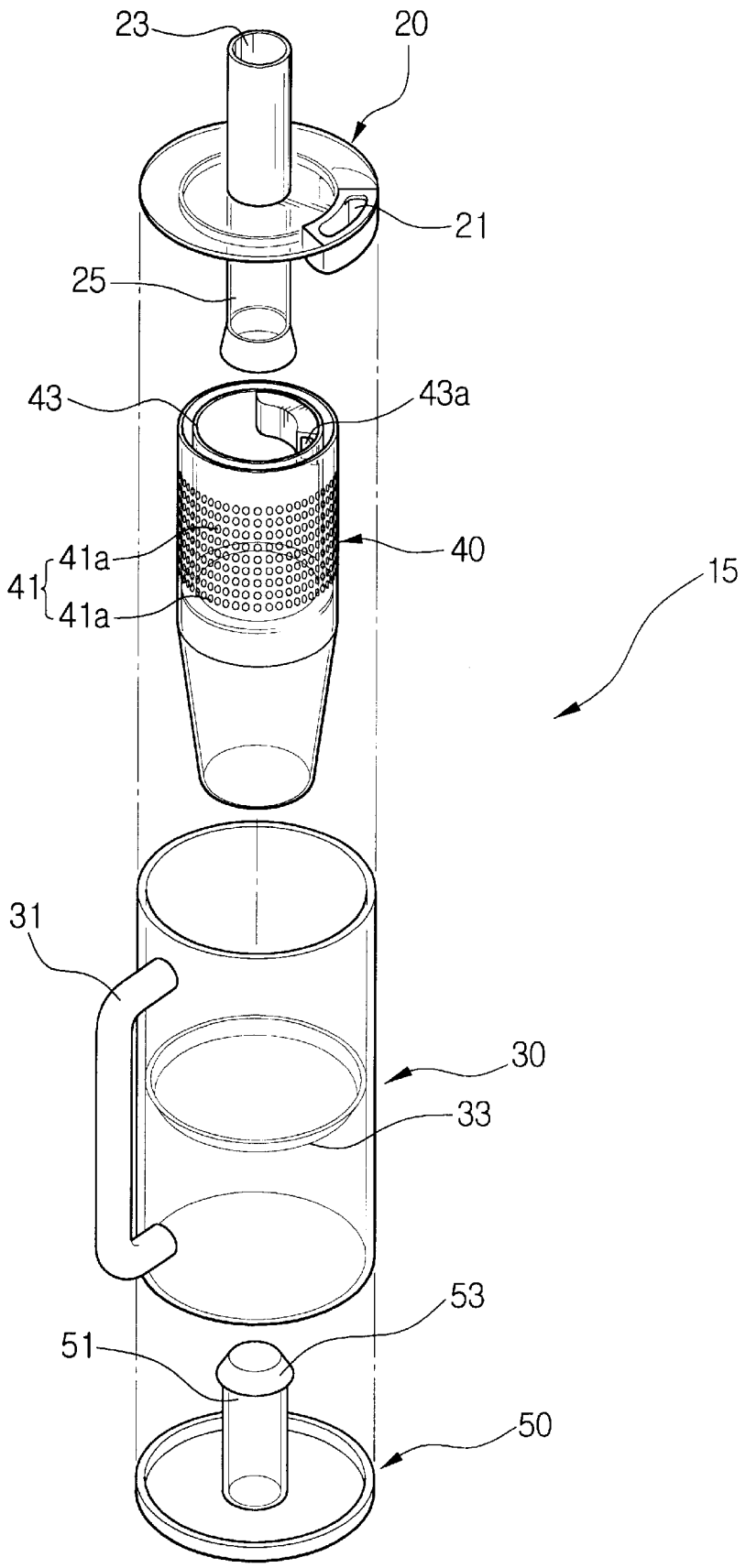
FIG. 2 is an exploded view of the cyclone type dust collector of FIG. 1.
Figure 3:
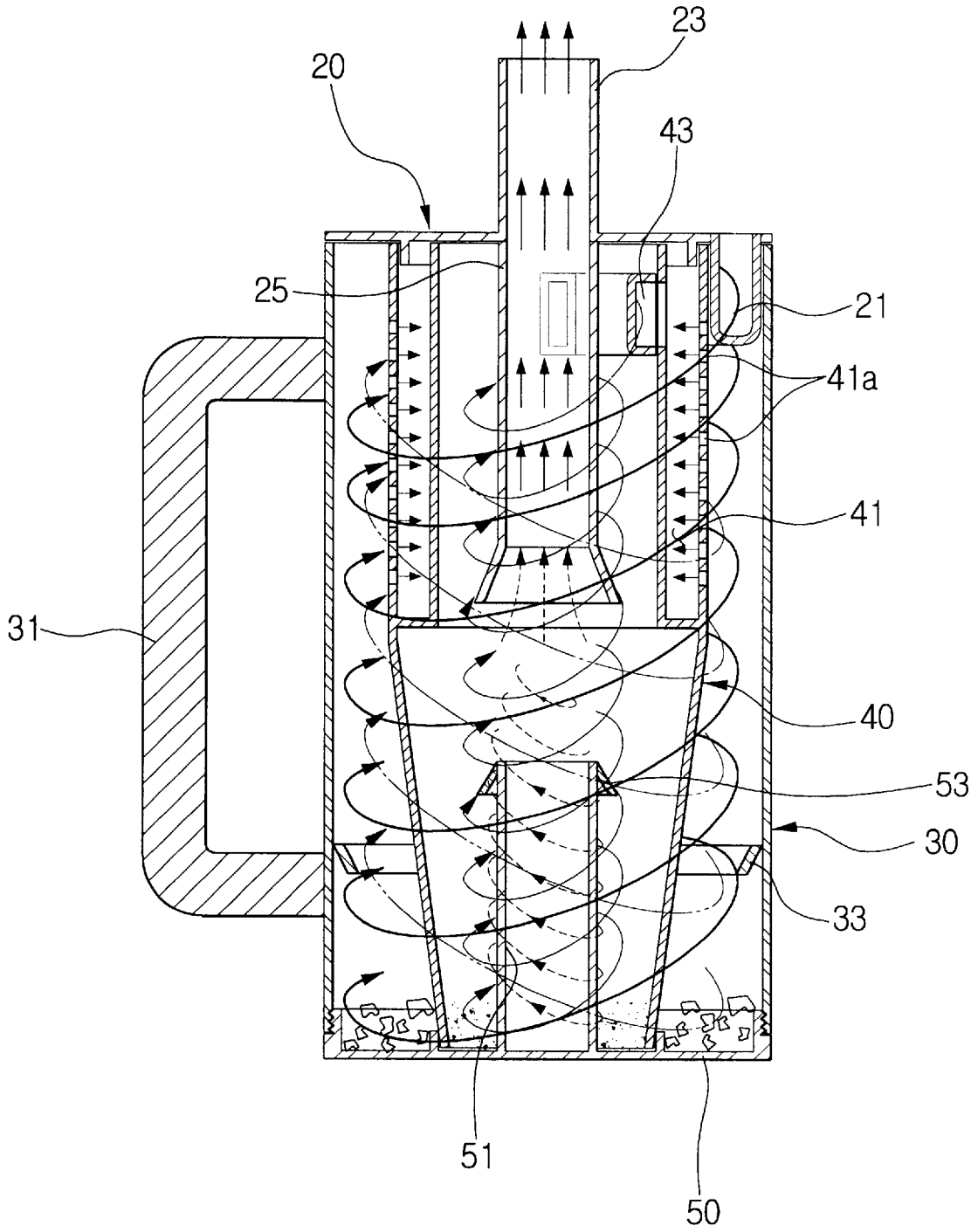
FIG. 3 is a sectional view of the cyclone type dust collector of FIG. 2 in an assembled state.

The cyclone type dust collector 15 separates and collects dust and contaminants from the air that is drawn in through the suction brush 13. To accomplish this purpose, the cyclone type dust collector 15, as shown in FIGS. 2 and 3, includes a cover 20, a first cyclone receptacle 30, a second cyclone receptacle 40, a lower door 50, and a reverse flow prevention portion.

The cover 20 is substantially disk-shaped and has a first air inlet 21 and an air outlet 23. The first air inlet 21 and the air outlet 23 are respectively formed on an edge and a center of the cover 20. Accordingly, when the cyclone type dust collector 15 is mounted in the dust chamber 11, the first air inlet 21 and the air outlet 23 of the cover 20 are connected with the air inlet 16*a* of the suction hose 16 and the air outlet 17*a,* respectively. Further, in the center of the cover 20, an outlet pipe 25 is formed to be interconnected with the air outlet 23.

The first cyclone receptacle 30 is substantially cylindrical in shape and has two open ends. The cover 20 is mounted on the open upper end of the first cyclone receptacle 30, while the lower door 50 is mounted on the open lower end.

In accordance with the present invention, the first cyclone receptacle 30 and the cover 20, cooperate to draw air in through the first air inlet 21 and into a vortex having a centrifugal force, by which large particle contaminants are separated from the air. The first cyclone receptacle 30 may also be equipped with a handle 31.

The second cyclone receptacle 40 is also substantially cylindrical in shape and has two open ends and tape red side. The second cyclone receptacle 40 is concentrically disposed within the first cyclone receptacle 30 and connected to the cover 20. Further, the second cyclone receptacle 40 includes an outer body 41 having a grill with a plurality of fine holes 41*a* formed therein, through which air ascending in a reverse direction from the bottom of the first cyclone receptacle 30 passes. The second cyclone receptacle 40 also includes an inner body 43 having a second air inlet 43*a* for guiding the air, which has passed through the fine holes 41*a,* into a vortex. The inner body 43 is concentrically disposed within the outer body 41, with a predetermined gap therebetween.

The grill is formed on the outer body 41 with the fine holes 41*a* formed at a predetermined distance. Since the fine holes 41*a* are formed discontinuously, the air does not flow into the second cyclone receptacle 40 while descending toward the bottom of the first cyclone receptacle 30. It is also preferable that the first and second air inlets 21 and 43*a* partially overlap each other.

The lower door 50 is removably disposed at a lower end of the first cyclone receptacle 30 to allow disposal of the contaminants from the first and second cyclone receptacles 30 and 40. In this embodiment of the present invention, the lower door 50 is screwed onto the first cyclone receptacle 30.

The reverse flow prevention portion prevents contaminants from flowing upward from the lower portions of the first and second cyclone receptacles 30 and 40. The reverse flow prevention portion includes a main rib 33, which protrudes from an inner circumference of the first cyclone receptacle 30, and a reverse flow prevention pipe 51. The reverse flow prevention pipe 51 extends upward by a predetermined height from the center of the lower door 50.

The main rib 33 slopes in and down from the inner circumference of the first cyclone receptacle 30 toward the lower door 50, in order to effectively prevent contaminants from flowing upward from the bottom of first cyclone receptacle 30 along the inner circumference of the first cyclone receptacle 30.

The reverse flow prevention pipe 51 is formed in the center of the second cyclone receptacle 40. By restricting the flow of minute particle dust collected in the second cyclone receptacle 40, the reverse flow prevention pipe 51 minimizes the possibility of a reverse flow of the minute particle dust. Further, the reverse flow prevention pipe 50 has a sub-rib 53 that radially extends from the upper circumference of the reverse flow prevention pipe 50. The sub-rib 53 restricts the minute particle dust from flowing from the second cyclone receptacle 40 along the outer circumference of the reverse flow prevention pipe 50. The sub-rib 53 is downwardly inclined by a predetermined angle from the upper circumference of the reverse flow prevention pile 50.

The operation of an upright type vacuum cleaner with a cyclone type dust collector in accordance with the present invention will be described below.

First, the vacuum cleaner, in which the cyclone type dust collector 15 is installed, is turned on. The suction brush 13 draws air, along with ambient dust and other contaminants, on and around the cleaning surface into the vacuum cleaner. The air flows through the suction hose 16 and air inlet 16*a,* to the first air inlet 21 of the dust collector 15. After being drawn in, the cover 20 and first cyclone receptacle 30 cooperate to induce the air into a vortex. The vortex of air descends toward the lower door 50. At this time, the larger particle contaminants are separated by the centrifugal force of the vortex and collected on the bottom of the first cyclone receptacle 30.

Once the vortex of air reaches the bottom of the first cyclone receptacle 30, the vortex of air ascends. In such a situation, some of the collected contaminants may also rise along the inner circumference of the first cyclone receptacle 30 with the ascending vortex of air. The rising contaminants are blocked by the main rib 33, however, and fall back to the bottom of the first cyclone receptacle 30. As a result, the main rib 33 improves the contaminant collecting efficiency of the first cyclone receptacle 30. Further, since the main rib 33 is inclined down and in toward the lower door 50, any possible reverse flow of contaminants along the main rib 33 is prevented.

As described above, the vortex of air rising from the lower door 50, flows into the second air inlet 43*a* via the outer body 41. After flowing in through the second air inlet 43*a,* the air is guided in a diagonal direction into a second vortex in the second cyclone receptacle 40. In the second cyclone receptacle 20, the minute particle dust is separated from the air by the centrifugal force of the vortex, and the minute particle dust falls onto the bottom of the second cyclone receptacle 40. The vortex of air, descending in the second cyclone receptacle 40, also rises after reaching the bottom. The ascending vortex of air in the second cyclone receptacle 40, reaches a defined space between the outlet pipe 25 and the reverse flow prevention pipe 51, and is drawn into the outlet pipe 25 by the different air pressures caused by different current velocities of upper and lower areas. The air in the outlet pipe 25 is then released through the air outlet 23.

Meanwhile, the lighter air, which reaches the center of the second cyclone receptacle 40, also turns up and directly ascends. According to this embodiment, the reverse flow prevention pipe 51 is provided at the center of the second cyclone receptacle 40, restricting any reverse flow or movement of the minute dust that is collected in the second cyclone receptacle 40. Further, in case of any reverse flow of a few minute particles of dust, the dust is blocked by the sub-rib 53 formed at the upper end of the reverse flow prevention pipe 51, and falls back to the bottom of the second cyclone receptacle 40. Here also, since the sub-rib 53 is downwardly inclined at a predetermined angle, the minute particle dust is blocked more efficiently.

When the first and second cyclone receptacles 30 and 40 are full of dust and contaminants, the lower door 50 may be opened to remove the dust and contaminants. In accordance with this embodiment of the present invention, the lower door 50 is removably screwed onto the first cyclone receptacle 30.

Figure 4:
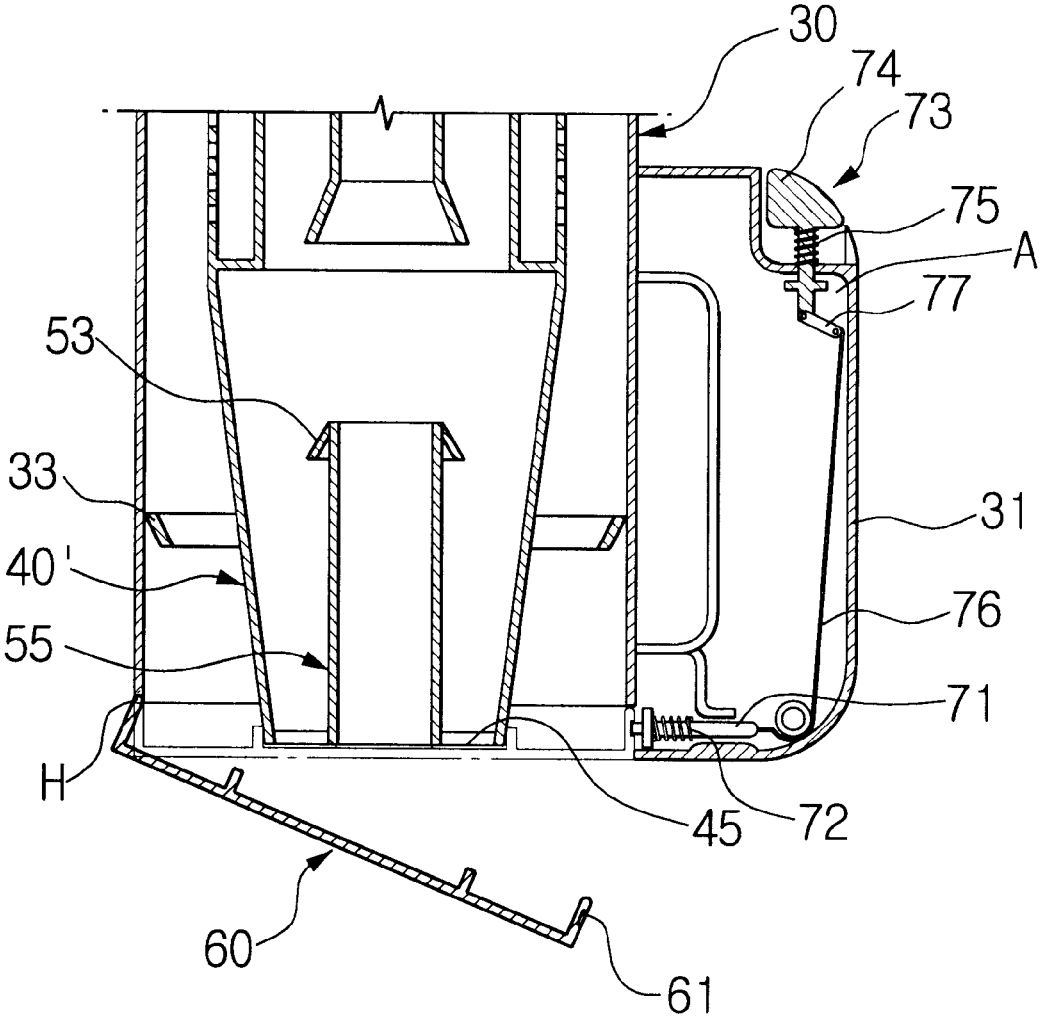
FIG. 4 is a partially sectional view of a cyclone type dust collector in accordance with another preferred embodiment of the present invention.

FIG. 4 is a schematic sectional view illustrating a cyclone type dust collector in accordance with another preferred embodiment of the present invention. Since the basic structure of the dust collector is identical to that shown in FIGS. 2 and 3, like elements will be given the same reference numerals throughout the description.

The cyclone type dust collector shown in FIG. 4 includes a hinge shaft H which pivotally connects a side of the lower door 60 to the first cyclone receptacle 30. Since the lower door 60 is coupled to the first cyclone receptacle 30 via the hinge shaft H, the reverse flow prevention pipe 55 is supported on the bottom of the second cyclone receptacle 40 by a plurality of ribs 45.

Further, the cyclone type dust collector includes a locking/unlocking portion for locking or unlocking the other end of the lower door 60 to or from the first cyclone receptacle 30.

The locking/unlocking portion includes a locking groove 61 formed in the lower door 60, a locking rod 71 movably disposed on a handle 31 of the first cyclone receptacle 30 to correspond to the locking groove 61, a first pressing member 72 for biasing the locking rod 71 in a direction where the locking rod 71 is inserted in the locking groove 61, and an unlocking unit 73 for removing the locking rod 71 from the locking groove 61 by overcoming the elasticity of the first pressing member 72. Here, it is preferable that the first pressing member 72 is a coil spring, which is disposed around the locking rod 71 to elastically bias the locking rod 71 toward the locking groove 61.

The unlocking unit 73 includes an unlocking button 74 formed at one side of the handle 31 in a manner such that the unlocking button 74 enters or exits with respect to one side, a second pressing member 75 for biasing the unlocking button 74 outward, a wire 76 having one end connected to the locking rod 71, and a pivot member 77 pivotally disposed in the handle 31. The Second pressing member 75 is a coil spring which is disposed around the unlocking button 74 to elastically bias the unlocking button 74 outward. It is also preferable that the wire 76 is an elastic member, such as an elastic string or a long coil spring. One end of the wire 76 is connected to the locking rod 71, and the other end is connected to one end of the pivot member 77. The other end of the pivot member 77 contacts the unlocking button 74. Accordingly, the center of the pivot member 77 is pivotally supported in the handle 31.

The operation of an upright type vacuum cleaner having the cyclone type dust collector of FIG. 4 will be described below.

In order to open or close the lower door 60, a user presses the unlocking button 74. When the unlocking button 74 is pressed into the handle 31, it presses one end of the pivot member 77 downward, while the other end of the pivot member 77 pivots upward. Simultaneously, the wire 76, which is connected to other end of the pivot member 77, also moves upward, pulling the locking rod 71. The wire 76 pulls the locking rod 71 to remove the locking rod 71 from the locking groove 61. As the locking rod 71 disengages from the locking groove 61, the weight of the lower door 60 causes the lower door 60 to pivot about the hinge shaft H, thereby opening the lower side of the first cyclone receptacle 30.

As described above, the dust collecting efficiency of the cyclone type dust collector is increased by preventing a reverse flow of collected contaminants. Furthermore, the locking/unlocking portion enables a user to open and close the lower door 60 more easily, thereby facilitating disposal of the contaminants that have collected in the dust collector.

Figure 5:
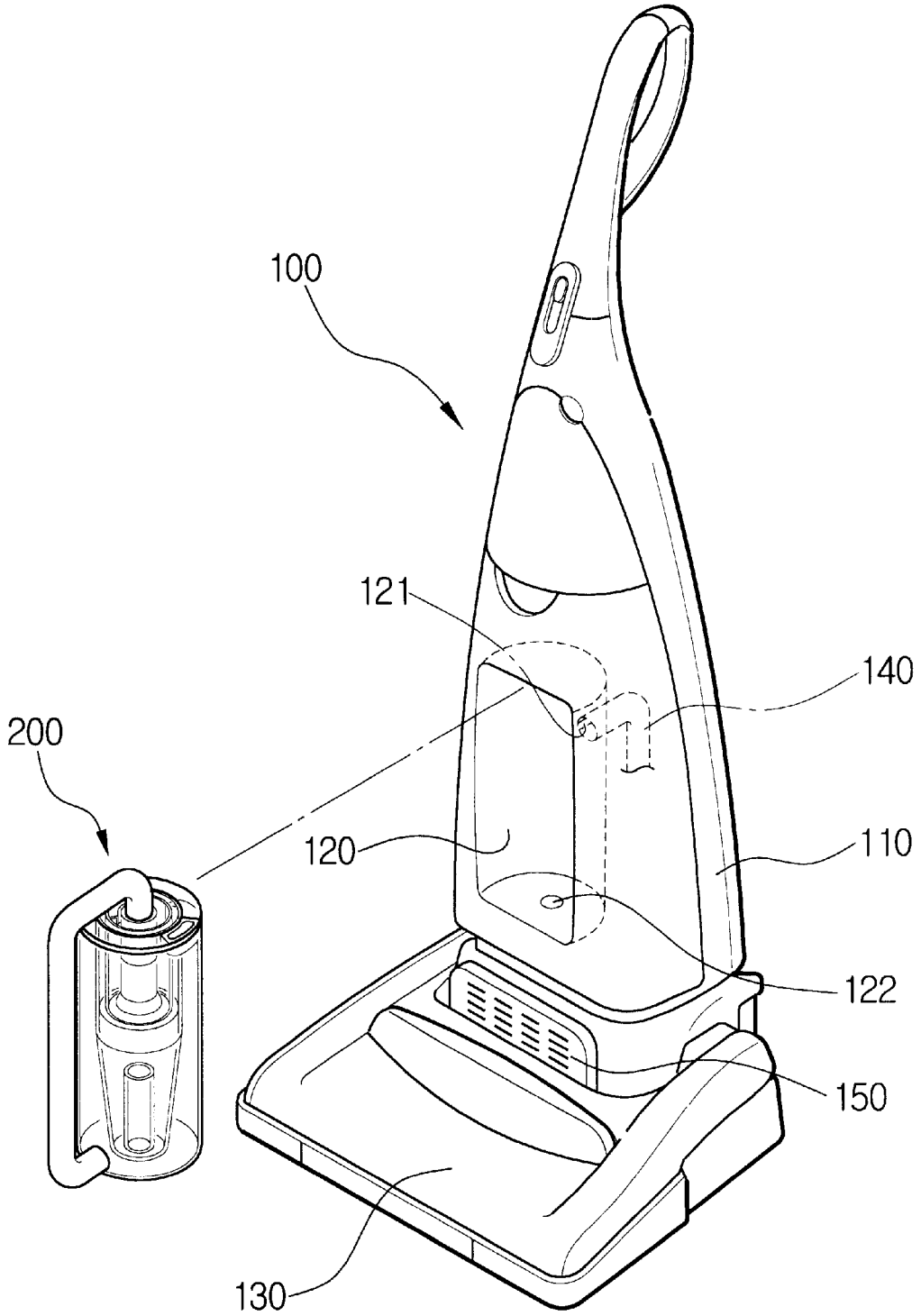
FIG. 5 is a perspective view of an upright type vacuum cleaner having a cyclone type dust collector in accordance with another preferred embodiment of the present invention.

FIG. 5 show the upright type vacuum cleaner 100 in accordance with another preferred embodiment of the present invention. The vacuum cleaner 100 includes a body 110 having a dust chamber 120 and a motor driving chamber 150, and a cyclone type dust collector 200 removably disposed in the dust chamber 120. A suction brush 130 is pivotally connected to a lower end of a vacuum cleaner body 110. The suction brush 130 is connected to a suction hose 140, which in turn is connected to an air inlet 121 formed on a side of the dust chamber 120. The motor driving chamber 150 is interconnected with the dust chamber through an air outlet 122 that is formed on the bottom of the dust chamber 120.

Figure 6:
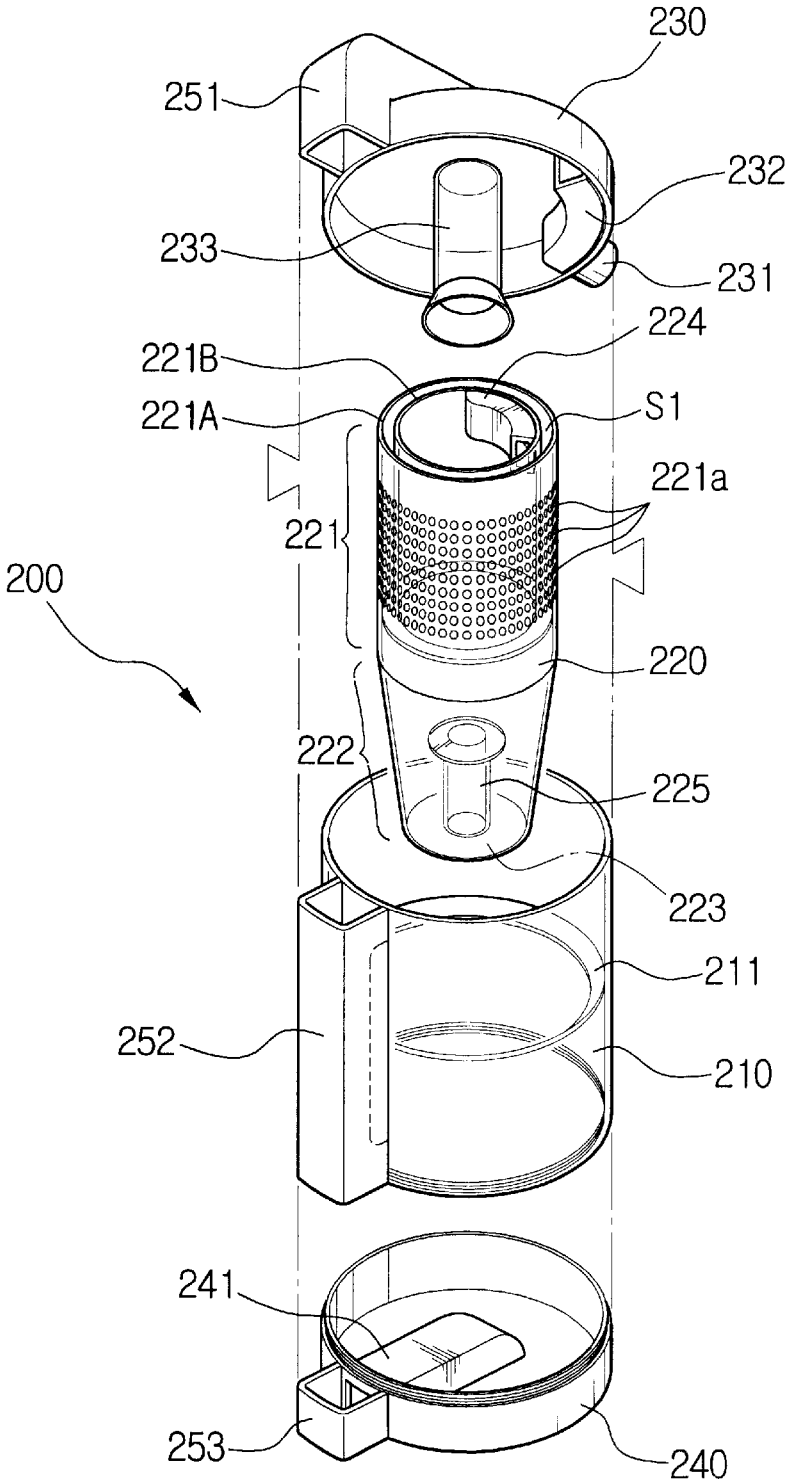
FIG. 6 is an exploded view of the cyclone type dust collector of FIG. 5.
Figure 7:
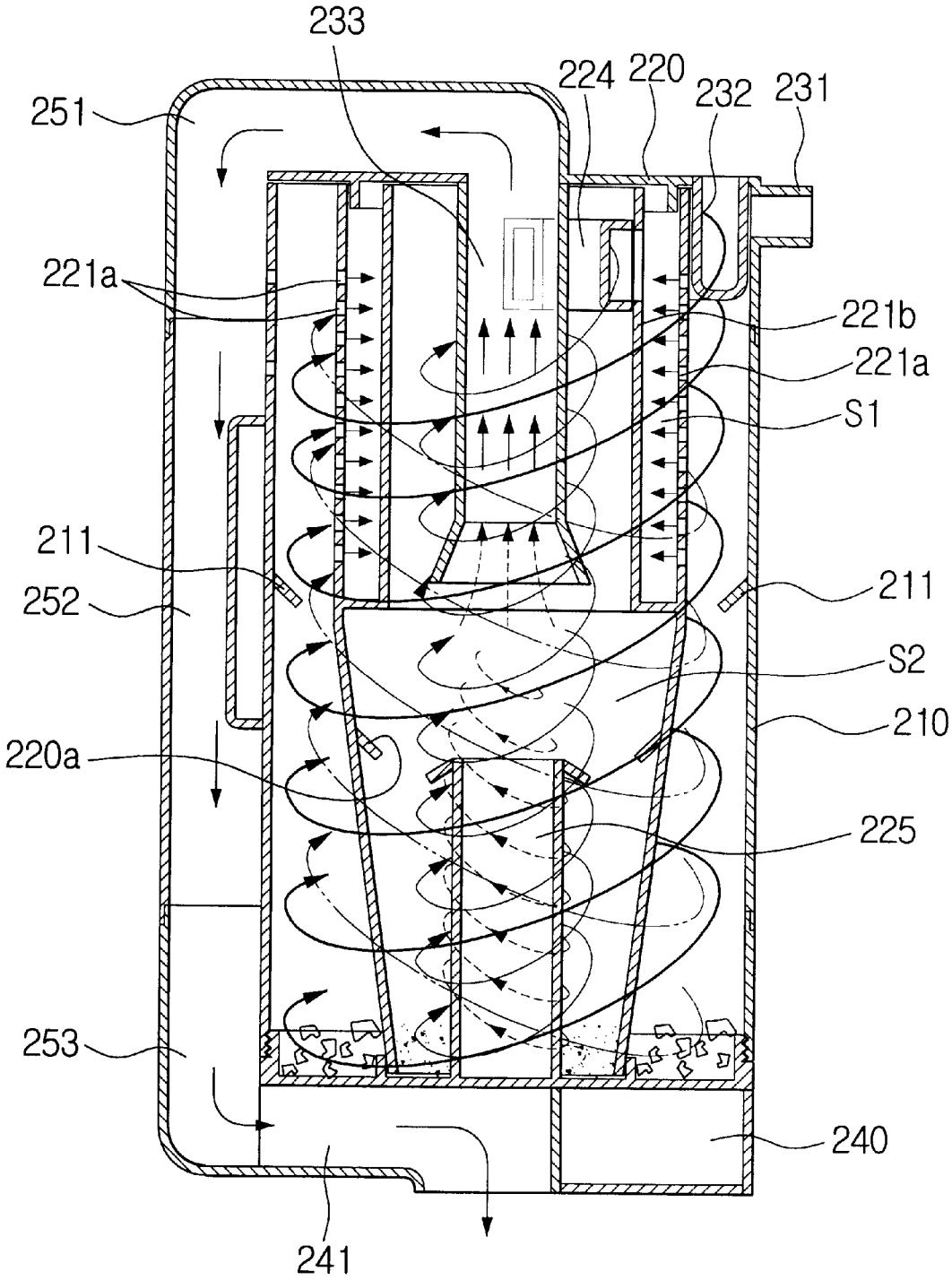
FIG. 7 is a sectional view of the cyclone type dust collector of FIG. 6 in an assembled state.

The cyclone type dust collector 200 separates by centrifugal force and collects contaminants from the air that is drawn in through the suction brush 130. As shown in FIGS. 6 and 7, such a cyclone type dust collector 200 includes a first cyclone receptacle 210, which is substantially cylindrical and has two open ends, a second cyclone receptacle 220 concentrically disposed in the first cyclone receptacle 210, a cover 230, and a base 240. The cover 230 and the base 240 are respectively mounted on the upper and lower portions of the first cyclone receptacle 210. First, second, and third outlet pipes 251, 252, and 253, respectively, are interconnected with the air outlet 122 to interconnect the second cyclone receptacle 220 with the dust chamber 120 and the motor driving chamber 150.

According to the present invention, an annular rib 211 protrudes from an inner circumference of the first cyclone receptacle 210 toward an axis thereof at a predetermined downward sloping angle. The annular rib is located approximately halfway between the top and bottom of the first cyclone receptacle 210.

Further, a tube 231 is provided on a side wall of the cover 230 and interconnected with the air inlet 121 that is formed in the dust chamber 120. The tube 231 is connected to an inlet pipe 232, which extends a predetermined length along a ceiling and inner circumference of the cover 230. The inlet pipe 232 has a predetermined radius of curvature in order to guide the air into a vortex when the air flows through the inlet pipe 232.

A suction pipe 233 extends downward a predetermined depth from a center of the ceiling of the cover 230 and into the second cyclone receptacle 220. The suction pipe 233 is interconnected with the first outlet pipe 251 and has a substantially funnel-like shape, in which a lower end of the suction pipe 233 extends radially outward.

A connecting pipe 241 is provided in the base 240 and is interconnected with the third outlet pipe 253. The connecting pipe 241 is interconnected to the motor driving chamber (not shown) through the air outlet 122 formed in the bottom of the dust chamber 120.

The second cyclone receptacle 220 is substantially cylindrical and has a plane upper side 221, a tapered sloping side 222 gradually decreasing in a diameter of the second cyclone receptacle 220, and a bottom side 223 for covering a narrower end of the second cyclone receptacle 220.

The plane side 221 has a dual-structure in which an outer body having a plurality of fine holes 221*a* is formed therein in a predetermined pattern (i.e., a grill 221A), and an inner body 221B concentrically disposed within the grill 221A. An air outlet (not shown) is formed in the upper end of the inner body 221B. Further, an outlet pipe 224 extends along the inner body 221B, diagonally curving at a predetermined radius of curvature to induce the air from the air outlet into vortex.

According to the present invention, it is preferable that the openings of the air outlet and outlet pipe 224 partially overlap the opening of the inlet pipe 232 of the cover 230. In addition, a reverse flow prevention pipe 225 extends upward a predetermined height from the center of the bottom side 223 of the second cyclone receptacle 220. The reverse flow prevention pipe 225 is a pipe member which has open upper end, and a lower end that is closed by the bottom side 223 of the second cyclone receptacle 220.

As shown in FIG. 7, the reverse flow prevention pipe 225 is arranged in such a manner that the reverse flow prevention pipe 225 faces the funnel-shaped suction pipe 233 along the substantially same axis. Further, the leading ends of the suction pipe 233 and the reverse flow prevention pipe 225 are spaced from each other by a predetermined distance to define a second space S2 therebetween.

Meanwhile, as shown in FIG. 6, the first, second, and third outlet pipes 251, 252, and 253 are integrally formed on the outer surface of the cover 230, the first cyclone receptacle 210, and the base 240, respectively, and are interconnected with each other. Although the first, second, and third outlet pipes 251, 252, and 253 are separately formed in this embodiment, the same can be replaced by one pipe member as well.

Another variation may be applied, in which a predetermined portion of the second outlet pipe 252 is spaced apart from the first cyclone receptacle 210 (see FIG. 6) to serve as a handle.

The operation of the upright type vacuum cleaner 100 having the cyclone type dust collector 200 in accordance with the present invention will be described below.

When the vacuum cleaner 100, with the cyclone type dust collector 200 installed in the dust chamber 120, is turned on, air and dust and contaminants entrained in the air are drawn in through the suction brush 130, through the suction hose 140 and the air inlet 121, and into the tube 231 formed in the cover 230 of the cyclone type dust collector 200. As the air flows through the inlet pipe 232 of the cover 230 and into the space defined between the first and second cyclone receptacles 210 and 220, respectively, the air is induced into a vortex (indicated by the larger headed, solid line arrow in FIG. 7). The air descends toward the bottom of the base 240. In this descending vortex of air, larger particle contaminants are separated from the air by centrifugal force and fall to the bottom of the base 240.

Next, the vortex of air descends in the space between the first and second cyclone receptacles 210 and 220 and ascends after reaching the bottom of the base 240. Here, dust and contaminants floating in the air are blocked by the reverse flow prevention rib 211, and fall back onto the bottom of the base 240.

When the vortex of air, rising from the bottom of the base 240, reaches the grill 221A of the second cyclone receptacle 220, the air flows into the first space s1 defined between the grill 221A and the inner body 221B through the plurality of fine holes 221*a*. Here, the contaminants are filtered once more, i.e., the large particles of the contaminants in the air are filtered out by the fine holes 221*a*.

After flowing through the fine holes 221*a* into the first space s1 between the grill 221A and inner body 221B, the air flows into the second cyclone receptacle 220 through an air outlet (not shown) formed on the upper end of the inner body 221B. The outlet pipe 224 is interconnected with the air outlet. While flowing into the second cyclone receptacle 220, the air is diagonally guided by the outlet pipe 224 and induced into a vortex (indicated by the smaller headed, solid line arrow in FIG. 7) around the inlet pipe 233 of the cover 230 and the reverse flow prevention pipe 225 of the second cyclone receptacle 220, sequentially.

Accordingly, minute particle dust is separated from the air by centrifugal force and falls to the bottom of the second cyclone receptacle 220.

Meanwhile, the descending vortex of air rises when it reaches the bottom side 223 of the second cyclone receptacle 220. In such a situation, floating dust and contaminants in the ascending air (indicated by the smaller headed, dotted line arrow in FIG. 7) are blocked by the rib 220*a* protruding from the inner circumference of the second cyclone receptacle 220 and fall back to the bottom side 223 of the second cyclone receptacle 220. The ascending vortex of air reaches the second space s2, defined between the inlet pipe 233 of the cover 230 and the reverse flow prevention pipe 225 of the second cyclone receptacle 220. At the second space s2, the air is drawn directly into the inlet pipe 233 as a result of the different pressures caused by different flow velocities of the air at upper and lower areas of the second space s2. The air that has been drawn into the inlet pipe 233 (indicated by the short straight arrows in FIG. 7) is exhausted through first, second, and third outlet pipes 251, 252, and 253, exhaust port 122, and motor driving chamber 150.

The contaminants collected in the first and second cyclone receptacles 210 and 220 can be removed by separating the base 240 from the first cyclone receptacle 210 and disposing of the contaminants contained therein.

As shown in FIG. 7, the base 240 and the first cyclone receptacle 210 have threads, respectively, which are complementary to each other, enabling the base 240 to be secured to the first cyclone receptacle 210. In the alternative, the base 240 and the first cyclone receptacle 210 may be connected together other by a plurality of fastening methods.

As described above, in the upright type vacuum cleaner having the cyclone type dust collector described above, the minute dust particles and larger particle contaminants are systematically separated from the air based on their sizes. Further, since the cyclone type dust collector of the present invention has a filtering process that prevents a reverse flow of dust and contaminants, the cleaning performance and efficiency of the vacuum cleaner are greatly improved.

Further, by integrally forming the outlet pipe on the cyclone type dust collector, the vacuum cleaner body can be more compact in size. In addition, due to the detachable structure of the cyclone type dust collector, the dust and contaminants collected in the cyclone type dust collector can be disposed of more easily.

As stated above, a preferred embodiments of the present invention are shown and described. Although the preferred embodiments of the present invention have been described, it is understood that the present invention should not be limited to this preferred embodiments. Various changes and modifications can be made by one skilled in the art within the spirit and scope of the present invention as hereinafter claimed.

What is claimed is:

1. An upright type vacuum cleaner comprising:

a body having a dust chamber and a motor driving chamber;

a suction brush connected to the body;

cyclone type dust collecting means removably disposed in the dust chamber, for separating and collecting contaminants from air that is drawn in through the suction brush, the cyclone type dust collecting means comprising:

a cover having a first air inlet connected to a suction hose, the suction hose being connected to the suction brush and the dust chamber, the cover also having an air outlet connected to an exhaust hose, the exhaust hose being connected to the dust chamber and the motor driving chamber;

a first cyclone receptacle connected to the cover, the first cyclone receptacle inducing the air into a vortex to separate by centrifugal force and collect larger particle contaminants from the air;

a second cyclone receptacle disposed in the first cyclone receptacle, the second cyclone receptacle being connected to the cover and having a grill, the grill having a plurality of fine holes through which air from a bottom of the first cyclone receptacle flows, the second cyclone receptacle further including a second air inlet for guiding the air from the fine holes of the grill into a vortex;

a lower door removably mounted on an open lower end of the first cyclone receptacle, the lower door permitting disposal of contaminants from the first and second cyclone receptacles; and reverse flow preventing means for preventing a reverse flow of contaminants from the lower door.

2. The vacuum cleaner of claim 1, wherein the reverse flow preventing means further comprises an annular main rib protruding from an inner circumference of the first cyclone receptacle.

3. The vacuum cleaner of claim 1, wherein the reverse flow preventing means further comprises an annular main rib protruding from an inner circumference of the first cyclone receptacle, and a reverse flow prevention pipe protruding from a lower center of the second cyclone receptacle, the reverse flow prevention pipe having an annular sub-rib protruding from an outer circumference of the reverse flow prevention pipe for preventing a reverse flow of contaminants.

4. The vacuum cleaner either of claim 2 or claim 3, wherein the main rib is downwardly inclined toward the lower door.

5. The vacuum cleaner of claim 3, wherein the sub-rib integrally extends from an upper end of the reverse flow prevention pipe in a radial direction, the sub-rib downwardly inclined toward the lower door.

6. The vacuum cleaner of claim 1, wherein the grill comprises a plurality of fine holes formed along an outer circumference of the second cyclone receptacle, each fine hole being formed at a predetermined distance from adjacent fine holes.

7. The vacuum cleaner of claim 1, further comprising:

a hinge shaft for pivotally connecting a side of the lower door to a lower side of the first cyclone receptacle; and locking and unlocking means for locking and unlocking another side of the lower door to and from the first cyclone receptacle.

8. The vacuum cleaner of claim 7, wherein the locking and unlocking means comprises:

a lower door having a locking groove;

a locking rod movably disposed in the first cyclone receptacle to engage and disengage with the locking groove;

a first pressing member for biasing the locking rod toward the locking groove; and an unlocking unit for retracting the locking rod from the locking groove, the unlocking unit overcoming a force of the first pressing member.

9. The vacuum cleaner of claim 8, wherein the unlocking unit comprises:

an unlocking button disposed on a side of the first cyclone receptacle;

a second pressing member for biasing the unlocking button outwardly;

a wire having a first end and a second end, the first end being connected to the locking rod; and a pivot member having a first end and a second end, the first end of the pivot member being connected to the second end of the wire, the second end of the pivot member being connected to the unlocking button, the pivot member and the wire disengaging the locking rod from the locking groove when the unlocking button is depressed.

10. The vacuum cleaner either of claim 8 or claim 9, wherein the locking and unlocking means is disposed in a handle on an outer circumference of the first cyclone receptacle.

11. An upright type vacuum cleaner comprising:

a body having a dust chamber and a motor driving chamber;

a suction brush connected to the vacuum cleaner body and interconnected to the dust chamber through a connecting tube;

cyclone type dust collecting means removably disposed in the dust chamber for separating and collecting foreign substances from air that is drawn in through the suction brush, the cyclone type dust collecting means comprising:

a substantially cylindrical first cyclone receptacle having open upper and lower ends;

a second cyclone receptacle concentrically disposed within the first cyclone receptacle with a predetermined space therebetween, the second cyclone receptacle having open upper and lower ends;

a cover for covering the upper ends of the first and second cyclone receptacles;

a base for covering the lower ends of the first and second cyclone receptacles; and an air exhaust pipe for interconnecting the second cyclone receptacle to the motor driving chamber.

12. The vacuum cleaner of claim 11, wherein the cyclone type dust collector further comprises an annular reverse flow prevention rib protruding from an inner circumference of the first cyclone receptacle toward a center axis at a predetermined sloping angle.

13. The vacuum cleaner of claim 12, wherein the reverse flow prevention rib is downwardly inclined toward the base.

14. The vacuum cleaner of claim 11, wherein the cover comprises:

a tube provided along the inner circumference of the dust chamber, the tube being interconnected with a connecting channel, the connecting channel being connected to the dust chamber;

an inflow pipe radially extending a predetermined length along a ceiling and an inner circumference of the cover, the inflow pipe being interconnected with the tube; and a suction pipe protruding a predetermined depth from a center of the ceiling of the cover, the suction pipe being interconnected with the exhaust pipe.

15. The vacuum cleaner of claim 14, wherein the suction pipe has a funnel-like shape, in which a free end of the suction pipe extends radially from the suction pipe, gradually increasing a diameter of the suction pipe.

16. The vacuum cleaner of claim 11, wherein the second cyclone receptacle is substantially cylindrical shape and has a plane upper side, a tapered side gradually decreasing in a diameter of the cylinder, and a bottom side for covering one end of the cyclone receptacle, the plane upper side having a dual structure formed of an outer body having a plurality of fine holes uniformly formed therein, and an inner body disposed within the outer body at a predetermined distance from the outer body, the bottom side having a guiding tube extending a predetermined distance from the center of the second cyclone receptacle.

17. The vacuum cleaner of claim 16, further comprising an air outlet formed in an upper end of the inner body of the second cyclone receptacle, the air outlet having an opening partially overlapping an opening of the inflow pipe of the cover.

18. The vacuum cleaner of claim 17, further comprising a guide tube radially extending in a diagonal direction for inducing air from the air outlet into a vortex.

19. The vacuum cleaner of claim 11, wherein the exhaust pipe comprises a first exhaust sub-pipe formed on the outer surface of the cover, a second exhaust sub-pipe formed on an outer surface of the first cyclone receptacle, and a third exhaust sub-pipe formed on an outer surface of the base, the first, second and third exhaust sub-pipes being interconnected with each other.

20. The vacuum cleaner of claim 19, the second exhaust sub-pipe is spaced from the first cyclone receptacle to form a handle.

21. The vacuum cleaner of claim 11, wherein the base is removably connected to the first cyclone receptacle.

* * * * *